US010930245B2

(12) United States Patent
An

(10) Patent No.: US 10,930,245 B2
(45) Date of Patent: Feb. 23, 2021

(54) DISPLAY DEVICE AND DRIVING METHOD THEREOF

(71) Applicant: Samsung Display Co., Ltd., Yongin-si (KR)

(72) Inventor: Byoung Kwan An, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/571,551

(22) Filed: Sep. 16, 2019

(65) Prior Publication Data

US 2020/0143769 A1 May 7, 2020

(30) Foreign Application Priority Data

Nov. 5, 2018 (KR) ..... 10-2018-0134594

(51) Int. Cl.
*G09G 5/10* (2006.01)
*G09G 5/18* (2006.01)

(52) U.S. Cl.
CPC ..... *G09G 5/10* (2013.01); *G09G 5/18* (2013.01); *G09G 2320/0233* (2013.01); *G09G 2320/0646* (2013.01)

(58) Field of Classification Search
None
See application file for complete search history.

(56) References Cited

U.S. PATENT DOCUMENTS

| | | | | |
|---|---|---|---|---|
| 9,123,295 | B2 | 9/2015 | Jeong | |
| 9,530,346 | B2 | 12/2016 | Park | |
| 9,633,601 | B2 | 4/2017 | Cheon et al. | |
| 2013/0076803 | A1* | 3/2013 | Lee | G09G 3/3233 345/690 |
| 2015/0255019 | A1 | 9/2015 | Park et al. | |
| 2016/0307490 | A1* | 10/2016 | Lee | G09G 3/2022 |

FOREIGN PATENT DOCUMENTS

| | | | |
|---|---|---|---|
| KR | 10-2014-0070114 | A | 6/2014 |
| KR | 10-2015-0104662 | A | 9/2015 |
| KR | 10-2016-0010687 | A | 1/2016 |
| KR | 10-2016-0064331 | A | 6/2016 |
| KR | 10-2016-0123452 | A | 10/2016 |

* cited by examiner

*Primary Examiner* — Aneeta Yodichkas
(74) *Attorney, Agent, or Firm* — Lewis Roca Rothgerber Christie LLP

(57) ABSTRACT

There are provided a display device and a driving method thereof. The display device includes a timing controller configured to generate second image data from first image data, and to output the second image data, and an image display unit configured to output an image corresponding to the second image data, wherein the timing controller is configured to generate the second image data by correcting the first image data based on a comparison result between a target current value, which corresponds to a load value of the first image data, and a measured current value that is measured with respect to the image display unit.

14 Claims, 6 Drawing Sheets

DISPLAY DEVICE AND DRIVING METHOD THEREOF

CROSS-REFERENCE TO RELATED APPLICATION

This application claims priority to and the benefit of Korean patent application 10-2018-0134594 filed on Nov. 5, 2018 in the Korean Intellectual Property Office, the entire disclosure of which is incorporated herein by reference.

BACKGROUND

1. Field

Embodiments of the present disclosure generally relate to a display device and a driving method thereof.

2. Related Art

Recently, various types of display devices such as an organic light emitting display device, a liquid crystal display device, and a plasma display device have been widely used.

Each of the display devices includes an image display unit including pixels for displaying an image, a timing controller for generating control signals to be supplied to the pixels, a data driver for supplying a data signal to the pixels, and a scan driver for supplying a scan signal to the pixels.

The pixels of the image display unit are driven using a plurality of transistors. Such transistors operate at relatively high temperature due to heat generated in the display device. The transistor has a threshold voltage that changes while the transistor is operating at high temperature, and therefore, a leakage current occurs. As a result, the luminance of pixels may be decreased. Accordingly, a display device capable of adaptively controlling the luminance of pixels, corresponding to various environments, may be useful.

SUMMARY

Embodiments disclosed herein provide a display device capable of adaptively controlling the luminance and current amount of a pixel according to a load value of an image displayed in an image display unit, and a driving method of the display device.

Embodiments also provide a display device capable of reducing or preventing the acceleration of degradation of a transistor in a pixel due to an increase in temperature and allowing each pixel to emit light with a target luminance corresponding to a target current amount, and a driving method of the display device.

According to an aspect of the present disclosure, there is provided a display device including a timing controller configured to generate second image data from first image data, and to output the second image data, and an image display unit configured to output an image corresponding to the second image data, wherein the timing controller is configured to generate the second image data by correcting the first image data based on a comparison result between a target current value, which corresponds to a load value of the first image data, and a measured current value that is measured with respect to the image display unit.

The display device may further include a memory configured to store at least one target current value respectively corresponding to at least one load value, wherein the timing controller is configured to load a corresponding one of the at least one target current value stored in the memory according to a corresponding one of the at least one load value that corresponds to the first image data.

The timing controller may be configured to measure a current value of the image display unit during an initial driving period, determine the load value of the first image data received during the initial driving period, and update the target current value stored in the memory as the measured current value that is measured during the initial driving period corresponding to the determined load value.

When the target current value and the measured current value are different from each other, the timing controller may be configured to generate the second image data by correcting a luminance level of the first image data such that a current corresponding to the target current value flows through the image display unit corresponding to the second image data.

When the target current value is smaller than the measured current value, the timing controller may be configured to generate the second image data by decreasing the luminance level of the first image data.

When the target current value is larger than the measured current value, the timing controller may be configured to generate the second image data by increasing the luminance level of the first image data.

When the target current value and the measured current value are equal to each other, or when a difference between the target current value and the measure current value is within a preset range, the timing controller may be configured to generate the second image data without correcting the first image data.

According to another aspect of the present disclosure, there is provided a method for driving a display device, the method including measuring a measured current value of an image display unit, determining a determined load value of first image data, comparing a target current value corresponding to the determined load value and the measured current value to generate a comparison result, generating second image data by correcting the first image data based on the comparison result, and displaying an image corresponding to the second image data.

The method may further include storing at least one target current value respectively corresponding to at least one load value before the measuring of the measured current value of the image display unit.

The comparing the target current value and the measured current value may include loading a corresponding one of the at least one target current value that corresponds to the determined load value as the target current value.

The method may further include measuring a measured current value of the image display unit during an initial driving period, determining a load value of the first image data received during the initial driving period, and updating a stored target current value corresponding to the load value as the measured current value measured during the initial driving period.

The generating the second image data may include, when the target current value and the measured current value are different from each other, generating the second image data by correcting a luminance level of the first image data such that a current corresponding to the target current value flows through the image display unit according to the second image data.

When the target current value is smaller than the measured current value, the generating the second image data may include decreasing the luminance level of the first image data, and generating the second image data corresponding to the decreased luminance level.

When the target current value is larger than the measured current value, the generating of the second image data may include increasing the luminance level of the first image data, and generating the second image data corresponding to the increased luminance level.

When the target current value and the measured current value are equal to each other or when a difference between the target current value and the measure current value is within a preset range, the generating the second image data may include generating the second image data without correcting the first image data.

DETAILED DESCRIPTION

Figure 1:
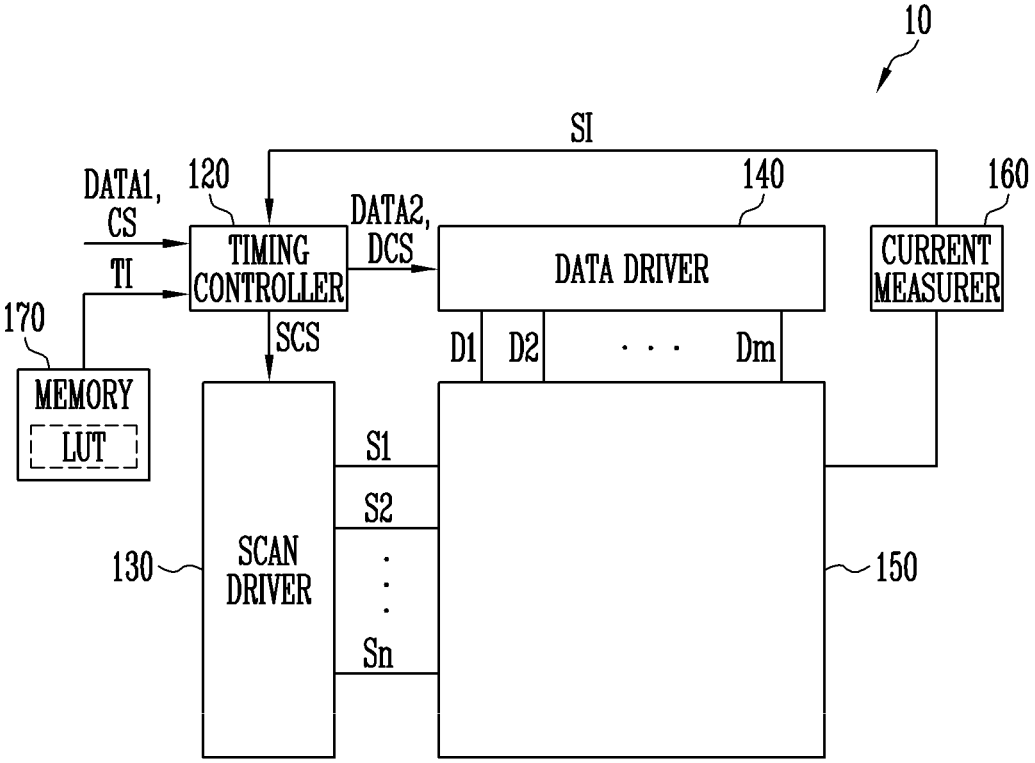
FIG. 1 is a block diagram illustrating a display device according to an embodiment of the present disclosure.

Features of the inventive concept and methods of accomplishing the same may be understood more readily by reference to the detailed description of embodiments and the accompanying drawings. Hereinafter, embodiments will be described in more detail with reference to the accompanying drawings. The described embodiments, however, may be embodied in various different forms, and should not be construed as being limited to only the illustrated embodiments herein. Rather, these embodiments are provided as examples so that this disclosure will be thorough and complete, and will fully convey the aspects and features of the present inventive concept to those skilled in the art. Accordingly, processes, elements, and techniques that are not necessary to those having ordinary skill in the art for a complete understanding of the aspects and features of the present inventive concept may not be described. Unless otherwise noted, like reference numerals denote like elements throughout the attached drawings and the written description, and thus, descriptions thereof will not be repeated. Further, parts not related to the description of the embodiments might not be shown to make the description clear. In the drawings, the relative sizes of elements, layers, and regions may be exaggerated for clarity.

Various embodiments are described herein with reference to sectional illustrations that are schematic illustrations of embodiments and/or intermediate structures. As such, variations from the shapes of the illustrations as a result, for example, of manufacturing techniques and/or tolerances, are to be expected. Further, specific structural or functional descriptions disclosed herein are merely illustrative for the purpose of describing embodiments according to the concept of the present disclosure. Additionally, as those skilled in the art would realize, the described embodiments may be modified in various different ways, all without departing from the spirit or scope of the present disclosure.

In the detailed description, for the purposes of explanation, numerous specific details are set forth to provide a thorough understanding of various embodiments. It is apparent, however, that various embodiments may be practiced without these specific details or with one or more equivalent arrangements. In other instances, well-known structures and devices are shown in block diagram form in order to avoid unnecessarily obscuring various embodiments.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present disclosure.

It will be understood that when an element, layer, region, or component is referred to as being "on," "connected to," or "coupled to" another element, layer, region, or component, it can be directly on, connected to, or coupled to the other element, layer, region, or component, or one or more intervening elements, layers, regions, or components may be present. However, "directly connected/directly coupled" refers to one component directly connecting or coupling another component without an intermediate component. Meanwhile, other expressions describing relationships between components such as "between," "immediately between" or "adjacent to" and "directly adjacent to" may be construed similarly. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present disclosure. As used herein, the singular forms "a" and "an" are intended to include the plural forms as well, unless the context clearly indicates otherwise. It will be further understood that the terms "comprises," "comprising," "have," "having," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

When a certain embodiment may be implemented differently, a specific process order may be performed differently from the described order. For example, two consecutively described processes may be performed substantially at the same time or performed in an order opposite to the described order.

The electronic or electric devices and/or any other relevant devices or components according to embodiments of the present disclosure described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the embodiments of the present disclosure.

Unless otherwise defined, all terms (including technical and scientific terms) used herein have the same meaning as commonly understood by one of ordinary skill in the art to which the present inventive concept belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Hereinafter, a display device and a driving method thereof will be described with reference to exemplary embodiments in conjunction with the accompanying drawings.

FIG. 1 is a block diagram illustrating a display device according to an embodiment of the present disclosure.

Referring to FIG. 1, the display device 10 may include a timing controller 120, a scan driver 130, a data driver 140, an image display unit 150, a current measurer 160, and a memory 170.

The timing controller 120 may determine a load value of externally received first image data DATA1 (e.g., data received from the outside). The first image data DATA1 may be image data for displaying a still image or image data for displaying a moving image.

The load value of the first image data DATA1 may be determined by multiplying a number or ratio of pixels that emit light in the image display unit 150 according to the first image data DATA1 by a current ratio of the image display unit 150. The current ratio may represent an amount of current flowing through the image display unit 150 according to the first image data DATA1 to a maximum amount of current flowing through the image display unit 150. However, the present disclosure is not limited thereto.

The timing controller 120 may determine a target current value TI corresponding to the determined load value of the image data DATA1. The target current value TI may represent a current value that is to flow through the image display unit 150 such that the image display unit 150 emits light with a luminance corresponding to the first image data DATA1. In an embodiment, the timing controller 120 may acquire the target current value TI, which corresponds to the load value of the first image data DATA1, using a Look-Up Table (LUT) stored in the memory 170.

Also, the timing controller 120 may receive a current value SI measured in a current frame with respect to the image display unit 150 from the current measurer 160.

The timing controller 120 may generate second image data DATA2 from the first image data DATA1 based on both the target current value TI acquired from the LUT and the measured current value SI. That is, when the target current value TI and the measured current value SI are different from each other, the timing controller 120 may generate the second image data DATA2 by correcting a luminance level (e.g., a grayscale) of the first image data DATA1 such that a current value flowing through the image display unit 150 in a next/subsequent frame approaches the target current value TI. When a leakage current is generated in the image display unit 150 due to heat generated in the display device 10, the current value flowing through the image display unit 150 may be higher than the target current value TI. Therefore, the timing controller 120 may correct the luminance level of the first image data DATA1 such that the current value flowing through the image display unit 150 is decreased.

In an embodiment, when a given difference between the target current value TI and the measured current value SI occurs (e.g., when the difference is within a preset range), the timing controller 120 may output the first image data DATA1 as the second image data DATA2 without correcting the first image data DATA1.

In one embodiment, the timing controller 120 may generate second image data DATA2 in a unit of one frame.

Meanwhile, the timing controller 120 may receive an externally supplied control signal CS, and may generate a scan control signal SCS and a data control signal DCS using the received control signal CS. The control signal CS may include a vertical synchronization signal, a horizontal synchronization signal, a data enable signal, a clock signal, and/or the like.

The timing controller 120 may transmit the scan control signal SCS to the scan driver 130. Also, the timing controller 120 may transmit the second image data DATA2 and the data control signal DCS to the data driver 140.

The scan driver 130 supplies a scan signal to scan lines S1 to Sn in response to the scan control signal SCS.

The data driver 140 may generate a data signal using the second image data DATA2 and the data control signal DCS, and may transmit the data signal to data lines D1 to Dm.

The image display unit 150 may include pixels coupled to the scan lines S1 to Sn and the data lines D1 to Dm to display an image. When a scan signal is supplied to the scan lines S1 to Sn, each of the pixels may be supplied with a data signal from the data lines D1 to Dm, and may emit light with a luminance corresponding to the data signal. In some embodiments, each of the pixels may be supplied with a data signal when a high-level scan signal is received. In other embodiments, each of the pixels may be supplied with a data signal when a low-level scan signal is received.

The image display unit 150 may be implemented with an organic light emitting display panel, a liquid crystal display panel, a plasma display panel, etc., but the present disclosure is not limited thereto.

The current measurer 160 measures a current value SI flowing through the image display unit 150, and transfers the measured current value SI to the timing controller 120. The current measurer 160 may be electrically coupled to a specific node of each of the pixels of the image display unit 150, to measure a current flowing through the pixel (e.g., may be electrically coupled to an Organic Light Emitting Diode (OLED) provided in the pixel).

Although the current measurer 160 is depicted as an independent component in the embodiment illustrated in FIG. 1, the present disclosure is not limited thereto. In various embodiments, the current measurer 160 may be integrally provided in any one of the timing controller 120 and the data driver 140.

The memory 170 may store the LUT. The LUT may include target current values TI respectively corresponding to load values of image data DATA.

Figure 2:
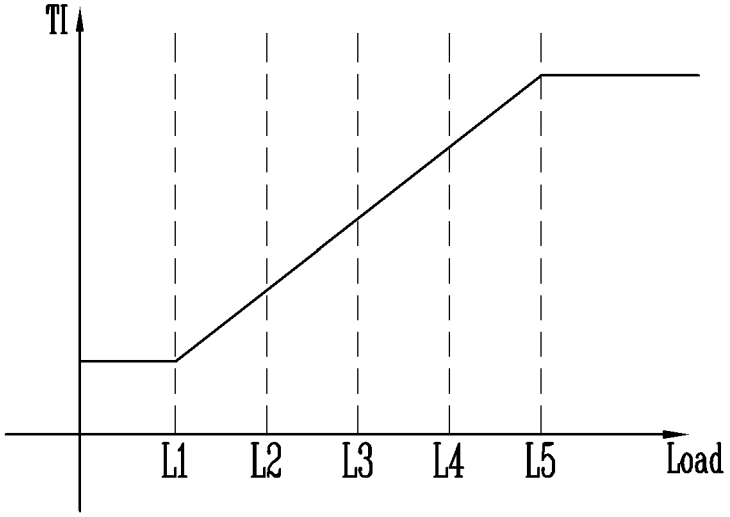
FIG. 2 is a graph illustrating an example of a target current value corresponding to a load value of an image.

As shown in FIG. 2, target current values TI that cause the image display unit 150 to emit light with a target luminance may be different depending on load values of image data. In various embodiments of the present disclosure, the memory 170 may store, in the LUT, target current values TI respectively corresponding to the load values of the image data.

When the temperature of the image display unit 150 increases due to heat generated while the display device 10 is being driven, a leakage current is generated in the pixels of the image display unit 150. As a result, a current value flows through the image display unit 150, and therefore, the image display unit 150 may emit light with a luminance that is different from a target luminance. In the present disclosure, to reduce or prevent deterioration of the image display unit 150, a target current value TI, which may be used such that the image display unit 150 emits light with a target luminance, is stored in advance in the LUT depending on a load value of the image data DATA. Further, a current value SI flowing through the image display unit 150 in a unit of a frame when the display device 10 is actually driven, may be compared with the target current value TI. In the present disclosure, the image data DATA is corrected based on the comparison result such that the target current value IT flows through the image display unit 150 in a next frame.

Hereinafter, the above-described technical feature of the present disclosure will be described in more detail.

Figure 3:
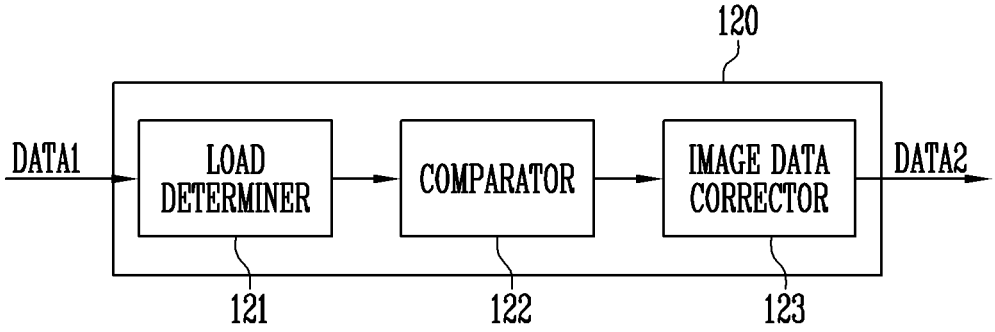
FIG. 3 is a block diagram illustrating a portion of a timing controller shown in FIG. 1.

FIG. 3 is a block diagram illustrating a portion of the timing controller shown in FIG. 1.

Referring to FIGS. 1 and 3, the timing controller 120 may include a load determiner 121, a comparator 122, and an image data corrector 123.

The load determiner 121 may determine a load value of first image data DATA1, and may output the determined load value to the comparator 122. The load value of the first image data DATA1 may be determined by multiplying a number or ratio of pixels that emit light in the image display unit 150 according to the first image data DATA1 by a current ratio of the image display unit 150. The current ratio may represent an amount of current flowing through the image display unit 150 according to the first image data DATA1 with respect to a maximum amount of current flowing through the image display unit 150. However, the present disclosure is not limited thereto. The load determiner 121 may determine a load value of the first image data DATA1, for example, in a unit of one frame.

The comparator 122 may compare a target current value TI, which corresponds to the load value of the first image data DATA1, and a current value SI that is measured with respect to the image display unit 150 by the current measurer 160, and may provide the comparison result to the image data corrector 123.

To this end, the comparator 122 may acquire a target current value TI, which corresponds to the load value of the first image data DATA1, using the LUT stored in the memory 170. The LUT may include target current values TI respectively corresponding to different load values of image data. Also, the comparator 122 may acquire a current value SI measured with respect to the image display unit 150 from the current measurer 160.

The comparator 122 may compare the acquired target current value TI and the measured current value SI, and may output the comparison result to the image data corrector 123. In an example, the comparator 122 may output a difference value between the target current value TI and the measured current value SI to the image data corrector 123. However, the present disclosure is not limited thereto, and the comparator 122 may output to the image data corrector 123 an arbitrary control value representing, or corresponding to, the difference between the target current value TI and the measured current value SI.

The image data corrector 123 may generate second image data DATA2 from the first image data DATA1 based on the comparison result received from the comparator 122. In an example, when the target current value TI and the measured current value SI are equal to each other, or when the difference between the target current value TI and the measured current value SI is within a preset range, the image data corrector 123 may output the second image data DATA2 without correcting the first image data DATA1.

In an example, when the target current value TI is larger than the measured current value SI, the image data corrector 123 may generate the second image data DATA2 by increasing a luminance level of the first image data DATA1. The increment of the luminance level may be in proportion to the difference between the target current value TI and the measured current value SI.

In an example, when the target current value TI is smaller than the measured current value SI, the image data corrector 123 may generate the second image data DATA2 by decreasing the luminance level of the first image data DATA1. The decrement of the luminance level may be in proportion to the difference between the target current value TI and the measured current value SI.

Figure 4:
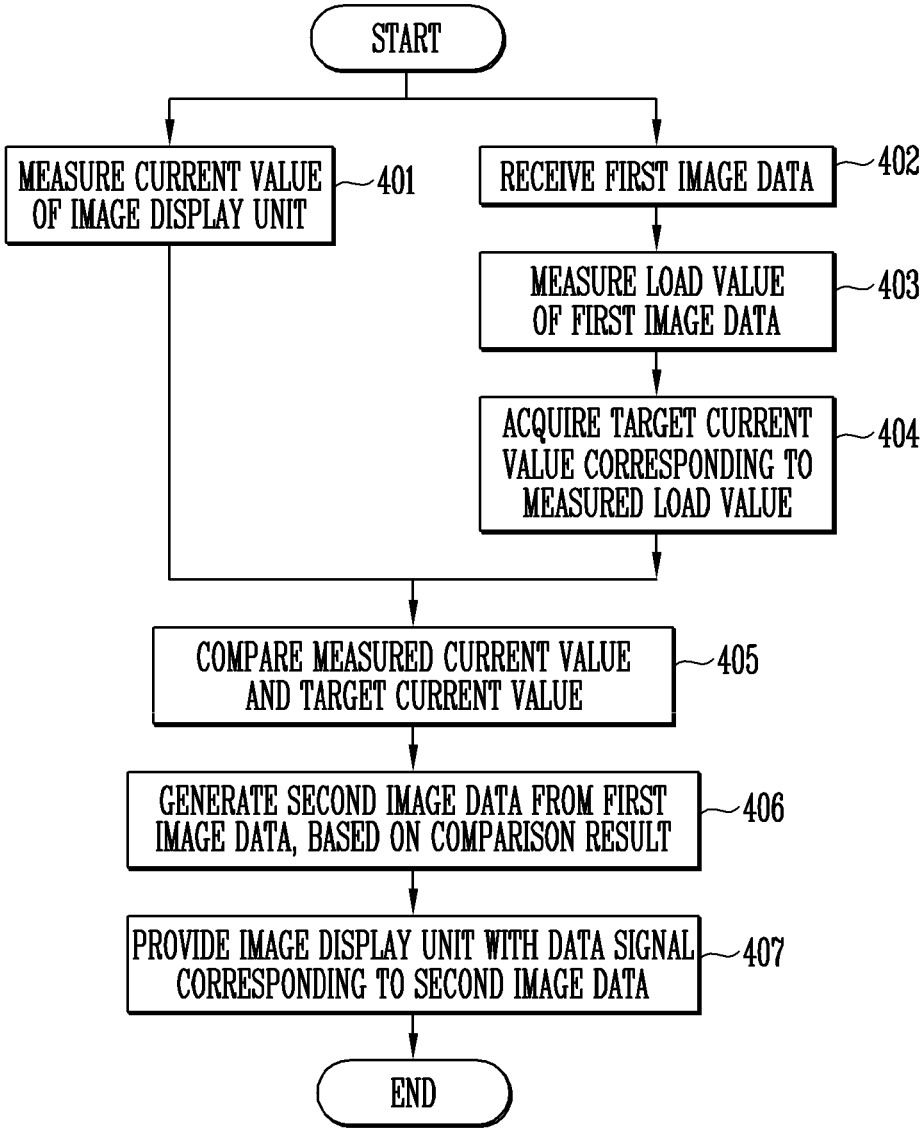
FIG. 4 is a flowchart illustrating a driving method of the display device according to a first embodiment of the present disclosure.
Figure 5:
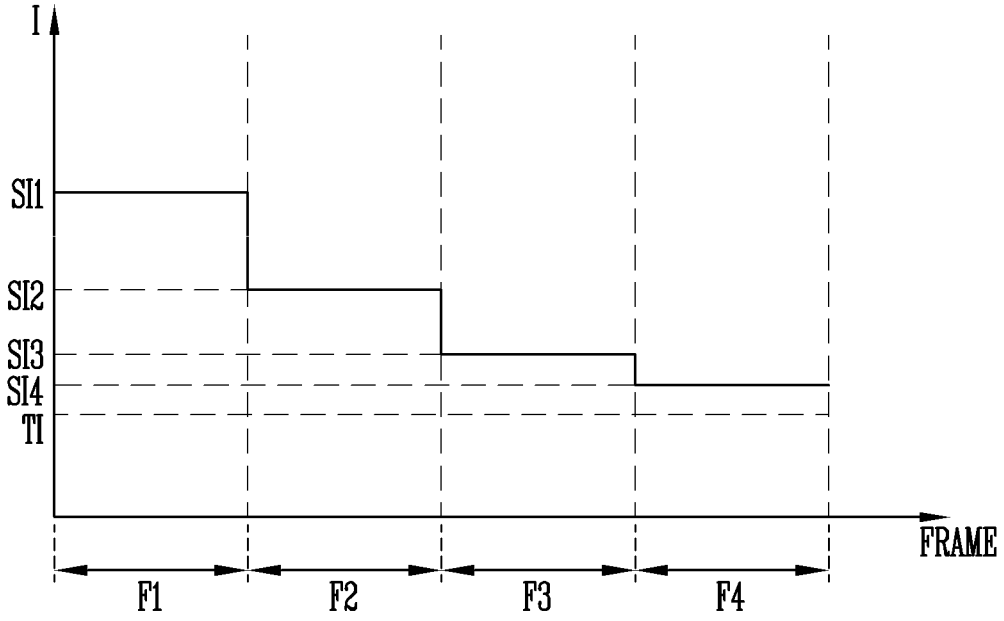
FIG. 5 is a diagram illustrating in detail a current control method of FIG. 4.

FIG. 4 is a flowchart illustrating a driving method of the display device according to a first embodiment of the present disclosure. FIG. 5 is a diagram illustrating in detail a current control method of FIG. 4.

Referring to FIG. 4, the display device 10 according to the first embodiment of the present disclosure may operate in a driving state in response to a power-on signal or the like, which is supplied from the outside.

Before the driving state, the display device 10 may store in advance a target current value TI for each load value of image data in the LUT. That is, the LUT may include target current values TI respectively corresponding to a plurality of load values. In an embodiment, the LUT may be stored in advance by a manufacturer of the display device 10, etc.

However, the present disclosure is not limited to the above-described embodiment. That is, in another embodiment, the LUT may be stored when the display device 10 is initially driven. In this embodiment, when the display device 10 is initially driven, the display device 10 may determine a load value of first image data DATA1 during a preset period, and may measure a current value flowing through the image display unit 150 during a frame in which the first image data DATA1 is displayed, and may then store the measured current value as a target current value TI in the LUT.

In still another embodiment, the LUT may be stored in advance before the driving state of the display device 10, and may be updated by reflecting pixel degradation while the display device 10 is being driven. For example, after the display device 10 enters into the driving state in response to the power-on signal or the like, a current value flowing through the image display unit 150 for each load value of image data DATA may be measured during a preset period (hereinafter, referred to as an initial driving period), and the LUT may be updated to have the measured current value SI as a target current value TI. The initial driving period is a period occurring prior to degradation of the display device 10, as the temperature of the image display unit 150 is not increased until the driving of the display device 10. The initial driving period may be determined in advance according to characteristics of the display device 10. This embodiment will be described in more detail with reference to FIGS. 6 to 9.

During the driving state, the display device 10 may measure a current value of the image display unit 150 in a unit of frame (401). Also, the display device 10 may receive first image data DATA1 in the unit of frame, which may be externally supplied (402).

The display device 10 may measure a load value of the received first image data DATA1 (403). The display device 10 may acquire a target current value TI corresponding to the measured load value from the pre-stored LUT (404).

The display device 10 may compare the measured current value SI of the image display unit 150 and the target current value TI (405). When the measured current value SI and the target current value TI are different from each other, the display device 10 may determine that current control is warranted.

The display device 10 may generate second image data DATA2 from the first image data DATA1 based on the comparison result between the measured current value SI and the target current value TI (406).

In an example, when the measured current value SI and the target current value TI are equal to each other, the display device 10 may use the second image data DATA2 without correcting the first image data DATA1.

In another example, when the measured current value SI and the target current value TI are different from each other, the display device 10 may generate the second image data DATA2 by correcting a luminance level (or voltage level) of the first image data DATA1 such that a target current value TI in a corresponding frame is supplied to the image display unit 150.

When a scan signal is supplied to the image display unit 150, the display device 10 may supply the image display unit 150 with a data signal corresponding to the generated second image data DATA2 (407). When the data signal is supplied, the image display unit 150 may emit light with a luminance corresponding to the controlled current value.

In various embodiments of the present disclosure, a current value flowing through the image display unit 150, which corresponds to the second image data DATA2 corrected by the display device 10, may not be necessarily equal to the target current value TI. That is, the display device 10 may limit a correction range of the first image data DATA1 such that the current value flowing through the image display unit 150, in accordance with the second image data DATA2, approaches the target current value TI.

In an embodiment, referring to the example shown in FIG. 5, the image display unit 150 displays first image data DATA1 in a first frame F1. The display device 10 performs current measurement on the image display unit 150 in the first frame F1. A current value SI1 measured in the first frame F1 is higher than a current value required to emit light with a target luminance due to a leakage current caused by an increase in temperature of the image display unit 150.

The display device 10 may compare the current value SI1 measured in the first frame F1 and a target current value TI corresponding to a load value of the first image data DATA1, and may determine whether the first image data DATA1 is to be corrected based on the comparison result. The display device 10 may determine whether the first image data DATA1 is to be corrected based on whether the current value SI1 measured in the first frame F1 and the target current value TI are equal to, or different from, each other.

When the display device 10 determines that the first image data DATA1 is to be corrected, the display device 10 may correct the first image data DATA1, corresponding to the comparison result between the current value SI1 measured in the first frame F1 and the target current value TI, and may generate second image data DATA2 according to the corrected first image data DATA1. When the display device 10 determines that the first image data DATA1 is not to be corrected, the display device 10 may generate the second image data DATA2 without correcting the first image data DATA1. The display device 10 may supply a data signal DS corresponding to the second image data DATA2 to the image display unit 150.

In a second frame F2, the image display unit 150 displays the second image data DATA2 generated in the first frame F1. The display device 10 performs current measurement on the image display unit 150 in the second frame F2. A current value SI2 measured in the second frame F2 is not equal to the target current value TI, but approaches the target current value TI more closely than the current value SI1 measured in the first frame F1 according to the current control in the first frame F1.

To display a still image during a plurality of frames, the first image data DATA1 may be transferred to the display device 10 during the second frame F2. To display a still image during a plurality of frames, an example in which the same first image data DATA1 is transferred to the display device 10 in the second frame F2 is illustrated in FIG. 5. However, the present disclosure is not limited thereto, and first image data DATA1 that is different from that in the first frame F1 may be transferred to the display device 10 in the second frame F2 so as to display a moving image.

The display device 10 may compare the current value SI2 measured in the second frame F2 and a target current value TI corresponding to the load value of the first image data DATA1, and may generate second image data DATA2, based on the comparison result. Also, the display device 10 may supply a data signal DS corresponding to the second image data DATA2 to the image display unit 150.

In a third frame F3, the image display unit 150 displays the second image data DATA2 generated in the second frame F2. A current value SI3 flowing through the image display unit 150 in the third frame F3 is not equal to the target current value TI, but further approaches the target current value TI to be closer thereto than the current value SI2 measured in the second frame F2 according to the current control in the second frame F2.

In a fourth frame F4, the image display unit 150 displays the second image data DATA2 generated in the third frame F3. A current value SI4 flowing through the image display unit 150 in the fourth frame F4 is not equal to the target current value TI, but further approaches the target current value TI to be closer thereto than the current value SI3 measured in the third frame F3 according to the current control in the third frame F3.

When the display device 10 displays a still image, the display device 10 may perform current control step-by-step through the above-described procedure such that the current value flowing through the image display unit 150 reaches the target current value TI.

According to the above-described embodiment of the present disclosure, the current amount and luminance of each pixel can be adaptively controlled according to a load value of image data in the display device 10. Accordingly, the pixel can emit light with a target luminance.

Figure 6:
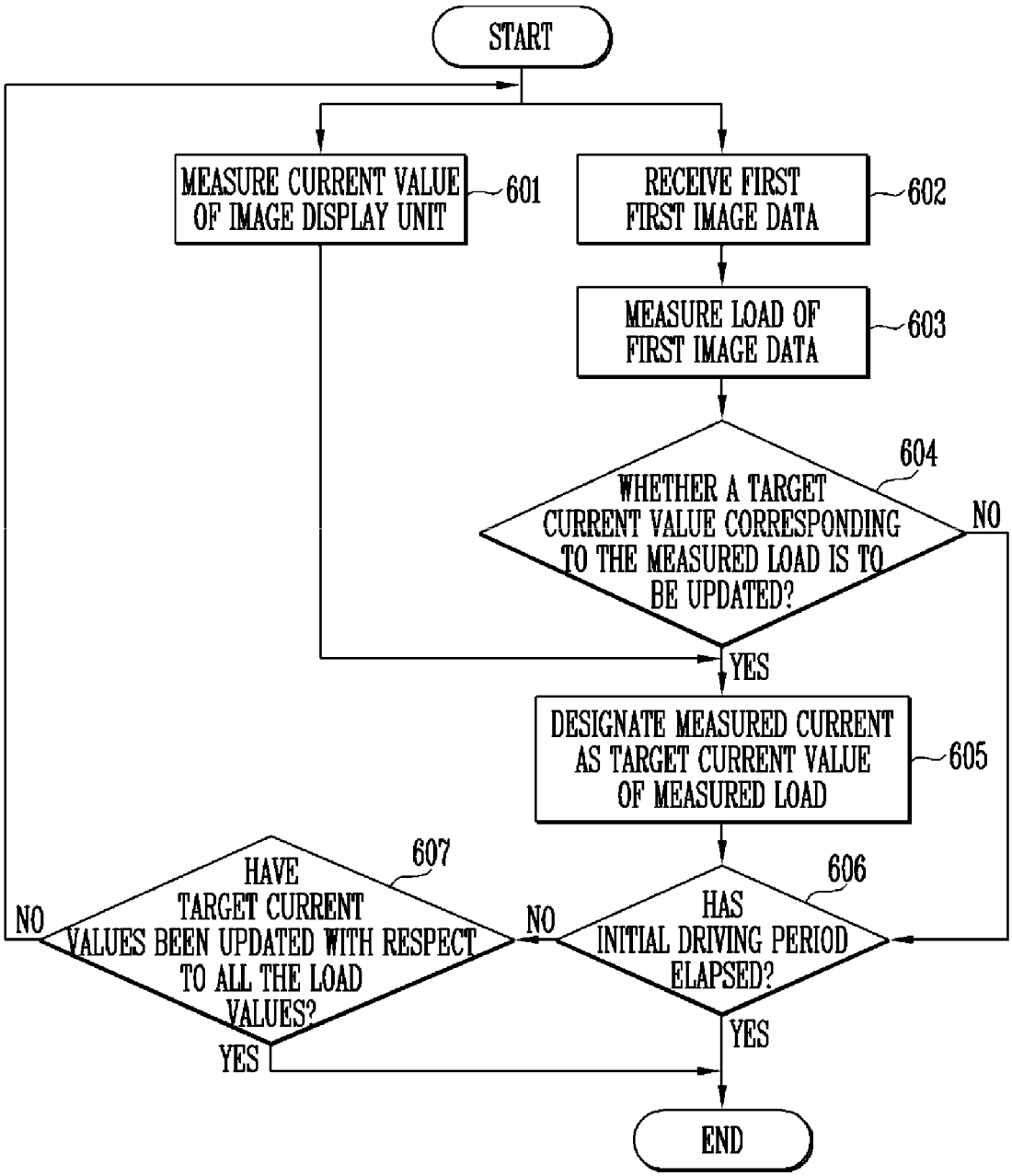
FIG. 6 is a flowchart illustrating a driving method of the display device according to a second embodiment of the present disclosure.
Figure 7:
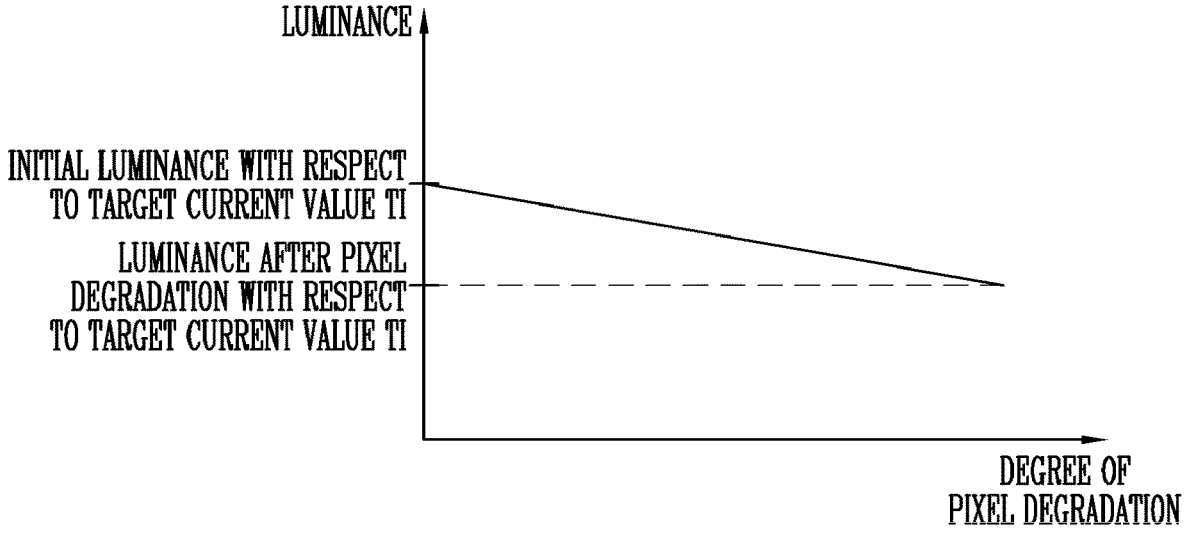
FIG. 7 is a diagram illustrating a change in luminance corresponding to a target current value due to pixel degradation.
Figure 8:
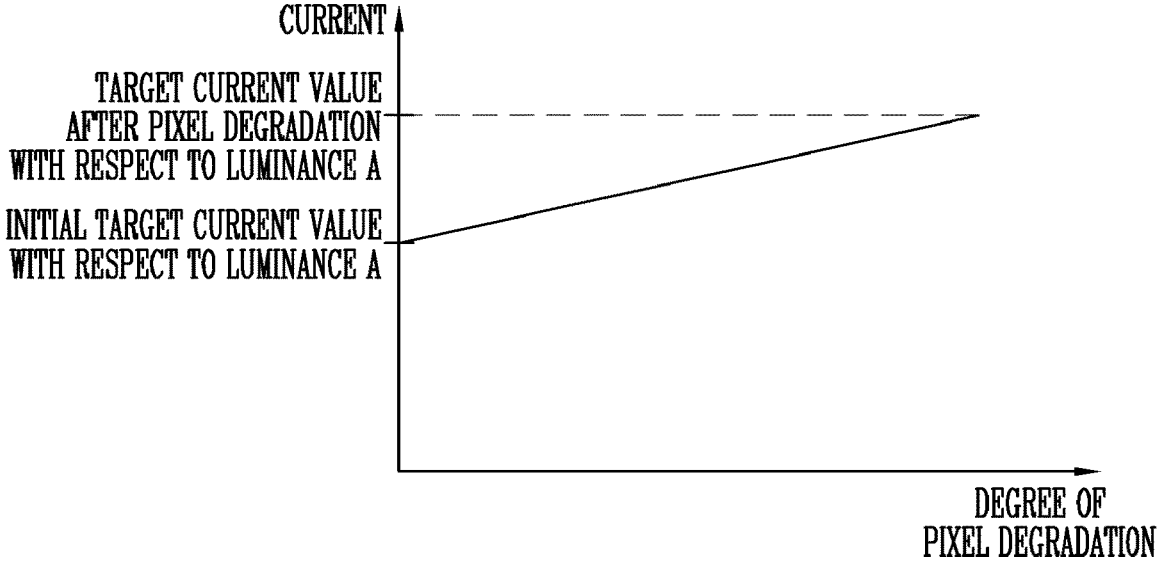
FIG. 8 is a diagram illustrating a suitable change in target current value due to pixel degradation.
Figure 9:
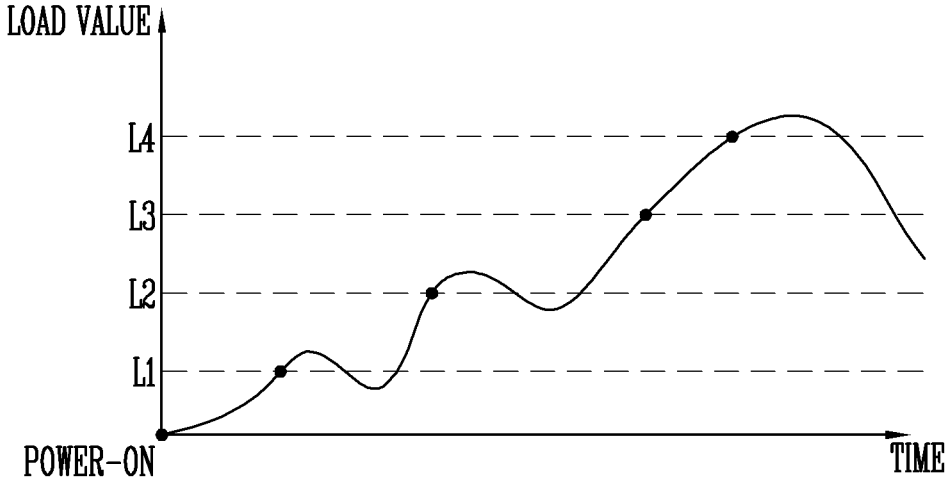
FIG. 9 is a diagram illustrating the driving method of the display device according to the second embodiment of the present disclosure.

FIG. 6 is a flowchart illustrating a driving method of the display device according to a second embodiment of the present disclosure. FIG. 7 is a diagram illustrating a change in luminance corresponding to a target current value due to pixel degradation. FIG. 8 is a diagram illustrating a suitable change in target current value due to pixel degradation. FIG. 9 is a diagram illustrating the driving method of the display device according to the second embodiment of the present disclosure.

Referring to FIG. 7, the emission efficiency of the pixels constituting the image display unit 150 is decreased due to degradation of internal transistors while the display device 10 is repeatedly performing power-on and power-off. As a result, the luminance of light emitted with respect to the same current value may be decreased. Therefore, as shown in FIG. 8, a current value required to emit light with the same target luminance, when pixel degradation of the display device 10 advances, is increased.

In the present disclosure, a target current value TI stored in the LUT when the display device 10 is initially driven may be updated such that the display device 10 emits light with a required luminance by reflecting the pixel degradation.

For example, referring to FIGS. 6 and 9, the display device 10 according to the second embodiment of the present disclosure may operate in a driving state in response to a power-on signal or the like, which may be externally supplied/supplied from the outside. Before the driving state, the display device 10 may store in advance a target current value TI for each load value of image data in the LUT. That is, the LUT may include target current values TI respectively corresponding to a plurality of load values L1, L2, . . . , and Ln. In an embodiment, the LUT may be stored in advance before the display device 10 is driven by a manufacturer of the display device 10, etc., or may be stored when the display device 10 was driven before the display device 10 is currently driven.

During an initial driving period after the display device 10 enters into the driving state, the display device 10 may measure a current value of the image display unit 150 in a unit of frame (601). Also, within the initial driving period, the display device 10 may receive a first one/first ones of the first image data DATA1 (e.g., first first image data) from the outside (602). The display device 10 may measure a load of the first one of the first image data DATA1 (603). The initial driving period is a period before degradation of the display device 10 occurs due to the temperature of the image display unit 150 being increased by the driving of the display device 10, and may be determined in advance according to characteristics of the display device 10.

In an embodiment, the display device 10 may determine whether a target current value TI corresponding to the measured load is to be updated (604). For example, the display device 10 may determine whether the measured load is one of a plurality of load values L1, L2, . . . , and Ln constituting, or contained within, the LUT. Also, the display device 10 may determine whether the target current value TI of the LUT has been updated with respect to the measured load within the initial driving period.

When the measured load is any one of the plurality of load values L1, L2, . . . , and Ln constituting the LUT, and when the target current value TI of the LUT with respect to the load value measured within the initial driving period is not updated, the display device 10 may update the LUT by storing the measured current value SI as a new target current value TI in the LUT (605).

Meanwhile, when the measured load is not any one of the plurality of load values L1, L2, . . . , and Ln constituting the LUT, or when the target current value TI of the LUT with respect to the load value measured within the initial driving period is updated, the display device 10 proceeds to a next step without updating the LUT.

The display device 10 may determine whether the initial driving period has elapsed (606). For example, the display device 10 may determine whether a period (e.g., a preset period) has elapsed from the time at which the display device 10 is powered on.

When the initial driving period elapses, the display device 10 may end the update operation of the LUT, according to the second embodiment of the present disclosure, and may control general driving of the display device 10 for image display.

When the initial driving period has not elapsed, the display device 10 may determine whether target current values TI have been updated with respect to all of the load values L1, L2, . . . , and Ln constituting the LUT (607). When the target current values TI are updated with respect to all of the load values constituting the LUT, the display device 10 may end the update operation of the LUT, and may control general driving of the display device 10 for image display.

When the target current values TI are not updated with respect to all of the load values constituting the LUT, the display device 10 may return to the previous step to receive a second one/second ones of the first image data DATA1 (e.g. second first image data) (602), and may measure a load of the second one of the first image data DATA1 (603). Also, the display device 10 may determine whether a target current value TI corresponding to the measured load value is to be updated (604). For example, the display device 10 may determine whether the measured load is one of the plurality of load values L1, L2, . . . , and Ln constituting the LUT. Also, the display device 10 may determine whether the target current value TI of the LUT has been updated with respect to the measured load within the initial driving period.

When the measured load is any one of the plurality of load values L1, L2, . . . , and Ln constituting the LUT, and when the target current value TI of the LUT with respect to the load value measured within the initial driving period is not updated, the display device 10 may update the LUT by storing the measured current value SI as a new target current value TI in the LUT (605).

Meanwhile, when the measured load is not any one of the plurality of load values L1, L2, . . . , and Ln constituting the LUT, or when the target current value TI of the LUT with respect to the load value measured within the initial driving period is updated, the display device 10 proceeds to the next step without updating the LUT.

The display device may update target current values with respect to all the load values L1, L2, . . . , and Ln constituting the LUT while repeating the above-described operations until the initial driving period of the display device 10 elapses (606) or until the target current values TI with respect to the load values L1, L2, . . . , and Ln are updated.

As described above, according to the present embodiment, the target current value TI can be corrected corresponding to pixel degradation of the display device 10, and accordingly, each pixel can emit light with a target luminance corresponding to a target current value even when the display device 10 is used for a long time.

In the display device and the driving method thereof according to embodiments of the present disclosure, the acceleration of degradation of the display device due to an increase in temperature is prevented, and thus each pixel can emit light with a target luminance corresponding to a target current amount even when the display device is used for a long time.

Further, in the display device and the driving method thereof according to the present disclosure, the current amount and luminance of each pixel can be adaptively controlled according to a load value of image data.

Embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present disclosure as set forth in the following claims, with functional equivalents thereof to be included therein.

What is claimed is:

1. A display device comprising:

a timing controller configured to generate second image data from first image data, and to output the second image data;

an image display unit configured to output an image corresponding to the second image data; and a memory configured to store at least one target current value respectively corresponding to at least one load value that is determined by multiplying a number or ratio of one or more pixels that emit light according to the first image data by a current ratio of the image display unit, wherein the timing controller is configured to:

generate the second image data by correcting the first image data based on a comparison result between a target current value, which corresponds to a load value of the first image data, and a measured current value that is measured with respect to the image display unit; and load a corresponding one of the at least one target current value stored in the memory according to a corresponding one of the at least one load value that corresponds to the first image data.

2. The display device of claim 1, wherein the timing controller is configured to measure a current value of the image display unit during an initial driving period, determine the load value of the first image data received during the initial driving period, and update the target current value stored in the memory as the measured current value that is measured during the initial driving period corresponding to the determined load value.

3. The display device of claim 1, wherein, when the target current value and the measured current value are different from each other, the timing controller is configured to generate the second image data by correcting a luminance level of the first image data such that a current corresponding to the target current value flows through the image display unit corresponding to the second image data.

4. The display device of claim 3, wherein, when the target current value is smaller than the measured current value, the timing controller is configured to generate the second image data by decreasing the luminance level of the first image data.

5. The display device of claim 3, wherein, when the target current value is larger than the measured current value, the timing controller is configured to generate the second image data by increasing the luminance level of the first image data.

6. The display device of claim 1, wherein, when the target current value and the measured current value are equal to each other, or when a difference between the target current value and the measured current value is within a preset range, the timing controller is configured to generate the second image data without correcting the first image data.

7. A method for driving a display device, the method comprising:

measuring a current value of an image display unit;

determining a load value of first image data by multiplying a number or ratio of one or more pixels that emit light according to the first image data by a current ratio of the image display unit;

comparing a target current value corresponding to the determined load value and the measured current value to generate a comparison result;

generating second image data by correcting the first image data based on the comparison result; and displaying an image corresponding to the second image data.

8. The method of claim 7, further comprising storing at least one target current value respectively corresponding to at least one load value before the measuring of the measured current value of the image display unit.

9. The method of claim 8, wherein the comparing the target current value and the measured current value comprises loading a corresponding one of the at least one target current value that corresponds to the determined load value as the target current value.

10. The method of claim 8, further comprising:

measuring a measured current value of the image display unit during an initial driving period;

determining a load value of the first image data received during the initial driving period; and updating a stored target current value corresponding to the load value as the measured current value measured during the initial driving period.

11. The method of claim 7, wherein the generating the second image data comprises, when the target current value and the measured current value are different from each other, generating the second image data by correcting a luminance level of the first image data such that a current corresponding to the target current value flows through the image display unit according to the second image data.

12. The method of claim 11, wherein, when the target current value is smaller than the measured current value, the generating the second image data comprises:

decreasing the luminance level of the first image data; and generating the second image data corresponding to the decreased luminance level.

13. The method of claim 11, wherein, when the target current value is larger than the measured current value, the generating of the second image data comprises:

increasing the luminance level of the first image data; and generating the second image data corresponding to the increased luminance level.

14. The method of claim 7, wherein, when the target current value and the measured current value are equal to each other or when a difference between the target current value and the measured current value is within a preset range, the generating the second image data comprises generating the second image data without correcting the first image data.

* * * * *